US005228517A

United States Patent [19]

Brownell

[11] Patent Number: 5,228,517

[45] Date of Patent: Jul. 20, 1993

[54] METHOD AND APPARATUS FOR COLLECTING PERCOLATING FLUIDS AND APPARATUS FOR THE INSTALLATION THEREOF

[75] Inventor: James R. Brownell, Fresno, Calif.

[73] Assignee: California State University Fresno Foundation, Fresno, Calif. ; a part interest

[21] Appl. No.: 514,934

[22] Filed: Apr. 26, 1990

[51] Int. Cl.[5] ..... E21C 41/10; E21B 43/30

[52] U.S. Cl. ..... 166/369; 166/50; 299/2

[58] Field of Search ..... 166/50, 369; 299/2

[56] References Cited

U.S. PATENT DOCUMENTS

| | | | |
|---|---|---|---|
| 3,261,401 | 7/1966 | Karr | 166/50 |
| 3,945,247 | 3/1976 | Anderson . | |
| 4,182,157 | 1/1980 | Fink . | |
| 4,341,110 | 7/1982 | Block . | |
| 4,410,216 | 10/1983 | Allen | 299/2 |
| 4,519,463 | 5/1985 | Schuh | 166/50 X |
| 4,533,182 | 8/1985 | Richards | 299/2 |
| 4,561,290 | 12/1985 | Jewell . | |
| 4,607,888 | 8/1986 | Trent et al. | 299/2 |
| 4,611,855 | 9/1986 | Richards | 299/2 |
| 4,759,227 | 7/1988 | Timmons . | |

*Primary Examiner*—William P. Neuder
*Attorney, Agent, or Firm*—Worrel & Worrel

[57] ABSTRACT

A method for collecting percolating fluids including selecting a first location in the formation at which the fluids are to be collected, accessing a second location in the formation laterally disposed relative to the first location, forming a passage extending from the second location into the first location and collecting fluid percolating from the formation into the passage.

An apparatus for collecting percolating fluids in a formation including a conduit having an internal passage, a distal end portion and an opposite proximal end portion and at least one opening extending through the conduit into communication with the internal passage.

An apparatus for installing a work object in a first location in a formation from a second location within a work area bounded by internal surfaces and laterally disposed relative to the first location, the apparatus including a frame adjustable as to length having opposite end portions and a pair of guide rails, a locking assembly for releasably securing the frame in a configuration adjusted as to length in which the opposite end portions of the frame engage the internal surfaces within the work area to capture the frame in the second location, a carrier mounted on the guide rails of the frame adapted to receive the work object and to be moved on the guide rails along a path of travel to carry the work object from the second location into the first location of the formation and a moving assembly mounted on the frame for moving the carrier along the guide rails to move the work object along the path of travel.

6 Claims, 6 Drawing Sheets

METHOD AND APPARATUS FOR COLLECTING PERCOLATING FLUIDS AND APPARATUS FOR THE INSTALLATION THEREOF

BACKGROUND OF THE INVENTION

1. Field of the Invention

The present invention relates to a method and apparatus for collecting percolating fluids and to an apparatus for the installation thereof and more particularly to such a method and apparatuses which are operable to collect percolating fluids, such as leaching waters in an unsaturated zone of soil, in such a manner as dependably to register the volume of percolating fluids over time permitting analysis of such percolating fluids for the presence of toxic, or otherwise undesirable substances, or substances otherwise to be monitored in the percolating fluid significantly more accurately and conveniently than has heretofore been possible.

2. Description of the Prior Art

With the advent of public concern as well as state and federal legislation regulating agriculture and industry with respect to the control, use and disposal of toxic compounds and the preservation of ground waters from contamination, there is an increasing need for monitoring percolating fluids within the earth. Although various methods have been employed in the past for monitoring such percolating fluids for a variety of different purposes, with the increasingly stringent regulations for protecting the soil and ground waters from contamination, the inadequacy of such prior art methods has become a chronic problem.

These inadequacies result both from the difficulty inherent in the practice of the methods as well as from the inability of the methods accurately to gauge both the quantity and content of the percolating fluids in an undisturbed soil structure. As a consequence, prior art methods for sampling percolating fluids are incapable of providing the information required properly to apply the regulations now in effect.

In order for such monitoring to accomplish the desired objectives, monitoring must take place in the unsaturated zone of soil, known as the "vadose zone", below the biologically active root zone and above the ground water within the saturated zone of soil. Prior art technology calls for the use of a suction lysimeter which must be placed in the vadose zone for operation. This method employs the technique of inserting a plurality of small ceramic cups in the vadose zone and applying suction thereto to draw off the percolating fluids collected for subsequent analysis. The problems existant with this technique reside in the fact that differentials between the vacuum applied and the moisture tension within the soil present variations which cannot be calculated in the relative volume of the leachate collected. This problem is inherent in the technique and therefore cannot be resolved. As a consequence, it is common practice to employ a disclaimer with regard to the reports generated using suction lysimeters noting the unreliability of the information gathered. Furthermore, it has been found that the solutes detected in the percolating fluid collected in some instances chemically react with the ceramic material of the cup of the lysimeter causing inaccurate estimates of solute concentrations. Still further, variations in the ceramic material from which the cups are manufactured produce still further variations in the analysis results.

Other prior art methods include the use of zero tension lysimeters which consist of a tray inserted beneath undisturbed or carefully repacked vadose soil. Prior art techniques in the use of such zero tension lysimeters have suffered from the difficulty and expense involved in the installation and maintenance of each zero tension lysimeter. In order to install such a lysimeter in undisturbed soil, a pit must be excavated in the earth adjacent to the zone to be tested, a tunnel excavated laterally of the pit beneath the zone to be monitored, and the zero tension lysimeter installed in the roof of the tunnel. The installation and maintenance of such lysimeters, particularly where a substantial number are required is extremely expensive and therefore quite unsatisfactory.

Therefore, it is known that it would be desirable to have a method and apparatus for collecting percolating fluids and an apparatus for the installation thereof which are operable dependably and precisely to sample percolating fluids in an undisturbed formation without requiring a vast number of such installations, without requiring exorbitantly expensive procedures for achieving such installation and for maintaining the installations once established and which are operable to collect percolating fluids of a quantity and content directly corresponding to that of the percolating fluids within the undisturbed formation for precise analysis of the content thereof.

SUMMARY OF THE INVENTION

Therefore, it is an object of the present invention to provide an improved method and apparatus for collecting percolating fluids and apparatus for the installation thereof.

Another object is to provide such a method and apparatuses which are operable to collect percolating fluids in such a manner that the fluids so collected bear a direct and precise relationship to the actual percolating fluids in a formation sampled so that the percolating fluid within the formation can be precisely identified both as to quantity over time and as to content so as to produce reliable results upon which decisions can dependably be made.

Another object is to provide such a method and apparatuses which permit such an installation to be made at minimal expense and requiring little or no maintenance over a long period of operation.

Another object is to provide such a method and apparatuses which can be operated over time requiring little or no maintenance while faithfully monitoring the formation being sampled.

Another object is to provide such a method and apparatuses which are particularly well suited for use in conjunction with and as a result of state and federal laws precluding the contamination of the earth and ground water and can be employed in agriculture and industry by private operators as well as by government officials and those operating on their behalf dependably to monitor those formations which are the subject of inquiry.

Another object is to provide such a method and apparatuses which are both convenient and inexpensive in installation and maintenance and yet are fully dependable in achieving their operational objectives.

Another object is to provide such a method and apparatuses which are particularly well suited to widely divergent usages without modification.

Another object is to provide such a method and apparatuses which conveniently permit the insertion of a line source, zero tension lysimeter beneath the portion of a vadose zone comprised of unsaturated soil beneath the root zone and above the saturated zone of soil and the ground water thereof.

Further objects and advantages are to provide improved elements and arrangements thereof in an apparatus for the purpose described which is dependable, economical, durable and fully effective in accomplishing its intended purpose.

These and other objects and advantages are achieved in the preferred embodiment of the method of the present invention including selecting a first location and the formation at which the fluids are to be collected, accessing a second location in the formation laterally disposed relative to the first location, forming a passage extending from the second location into the first location and collecting fluid percolating from the formation into the passage.

DESCRIPTION OF THE PREFERRED EMBODIMENT APPARATUS FOR COLLECTING PERCOLATING FLUIDS

Figure 4:
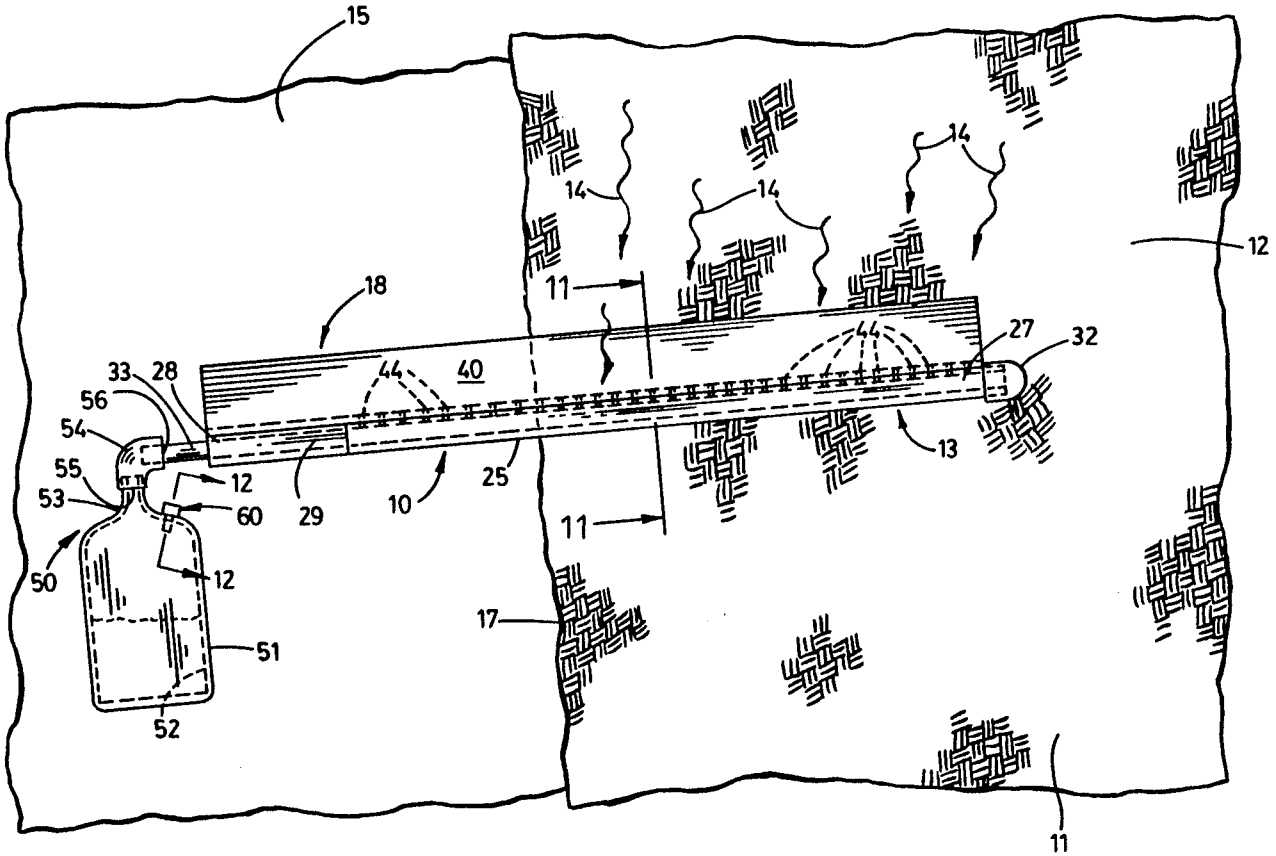
FIG. 4 is a somewhat enlarged, fragmentary, vertical section of the portion of the earth formation shown in FIG. 2 with the apparatus for collecting percolating fluids of the present invention disposed in its operable position in the formation.

The apparatus for collecting percolating fluids of the present invention is generally indicated by the numeral 10 in FIG. 4. In the practice of the method of the present invention, the apparatus 10, hereinafter to be described, is inserted in the earth 11 within a formation 12. While the method and apparatus have application to a wide variety of operative environments, for illustrative convenience, the method and apparatus are described herein in connection with the sampling of leaching waters in an unsaturated zone of soil. In this regard, as shown in FIG. 4, the particular formation to be sampled is selected by the operator. This typically, in the environment here involved, is a sight to be tested as to the constituent content of leaching water in an unsaturated, or vadose, zone of soil beneath the root zone of the formation and above the saturated or ground water zone of soil. The operator thus selects a first path or location 13 along which the apparatus 10 is to be installed. As shown in FIG. 4, arrows 14 indicate percolating fluids within the unsaturated zone.

Installation of the apparatus 10 is achieved by excavating a chamber or trench 15 adjacent to the first location 13 of the formation 12. The trench has a lower surface 16 and opposite vertical or wall surfaces 17. For purposes hereinafter to be described, the operator then selects a second path or location 18 directly laterally disposed relative to the first location 13 within the formation in which the apparatus 10 is to be installed.

Figure 11:
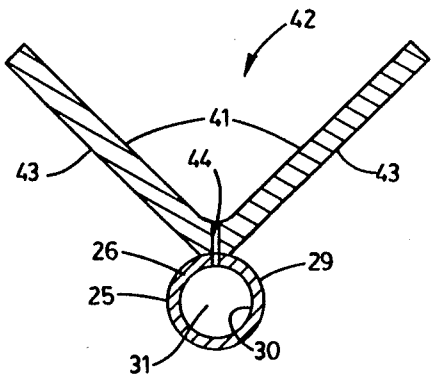
FIG. 11 is a somewhat enlarged transverse, vertical section of the apparatus for collecting percolating fluids taken on line 11—11 in FIG. 4.

Referring again more particularly to FIGS. 4, 11 and 12, the apparatus 10 has an elongated receiver or conduit 25 having a cylindrical wall 26. The conduit may be constructed of any suitable material including preferably nonferrous metal or a plastic material such as polyvinyl chloride. It is, of course, preferred to select a material which cannot react with otherwise contaminate the fluids collected by contact therewith.

The conduit 25 has a distal end portion 27 and an opposite proximal end portion 28. The conduit has a cylindrical external surface 29 and a cylindrical internal surface 30. A passage 31 defined by the internal surface 30 extends the full length of the conduit. A cap 32 is mounted on the distal end portion 27 of the conduit in sealing relation thereto. The proximal end portion has an externally screw threaded end portion 33.

An angle iron member 40 is mounted on the external surface 29 of the wall 26 of the conduit 25 substantially parallel to the longitudinal axis thereof. The angle iron member has an internal surface 41 which is v-shaped in cross section thus forming a trough 42. The angle iron member has an opposite external surface 43. A plurality of openings or holes 44 are extended through the angle iron member and the wall 26 of the conduit 25 so as to establish fluid communication between the trough 42 and the passage 31 of the conduit. Depending upon the objectives of the apparatus, the diameter of the holes and their spacing can be varied. It is, however, preferred that the holes be substantially evenly spaced and disposed in substantial alignment along the bottom of the trough to a point adjacent to the proximal end portion 28 of the conduit.

A container assembly 50 is mounted on the proximal end portion 28 of the conduit 25. More particularly, the container assembly includes a container 51 having an interior 52 and an externally screw threaded neck 53. An elbow fitting 54 having an internally screw threaded opening 55 and an opposite internally screw threaded opening 56 is mounted on the externally screw threaded neck 53 by the internally screw threaded opening 55 screw-threadably engaged therewith. While the container assembly 50 is shown in FIG. 4 in an installed condition, it is believed most convenient to have the container assembly detached from the conduit 25 until the conduit 25 is installed in the first location 13 of the formation 12, as will hereinafter be described.

Figure 12:
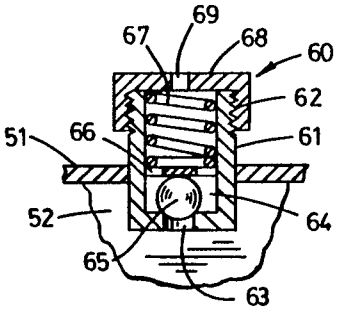
FIG. 12 is a somewhat enlarged, fragmentary vertical section taken on line 12—12 in FIG. 4.

The container assembly has an air valve assembly 60 shown best in FIG. 12. The air valve assembly has a housing 61 mounted in the container so as to extend into communication with the interior 52 thereof. The housing 61 has an externally screw threaded end portion 62 and an opposite air passage 63 communicating with the interior of the container. The housing defines a cylindrical chamber 64 in which is housed a ball 65. A spring plate 66 is slidably received in the chamber and is held in place against the ball 65 by a compression spring 67. A closure 68 is screw-threadably secured on the externally screw threaded end portion 62 of the housing 61 to retain the compression spring under compression thereby retaining the ball 65 in position in covering relation to the air passage 63. An air vent 69 is formed in the closure 68.

APPARATUS FOR INSTALLING A WORK OBJECT

The apparatus 10 can be installed, in accordance with the method of the present invention, by any suitable means. However, the apparatus for installing a work object 80 of the present invention is particularly well suited to this purpose. The apparatus is shown in FIG. 1 illustrating the manner in which it is installed within the trench 15 for installation of the apparatus 10 of the present invention.

The apparatus 80 has a main frame 81 having opposite end portions 82. An end plate 83 is mounted at the opposite end portion of the main frame on the left as viewed in FIG. 1 and an end plate 84 is mounted at the opposite end portion of the main frame on the right as viewed in FIG. 1. Each end plate has an outwardly facing surface 85 relative to the main frame and an opposite inwardly facing surface 86 relative to the main frame.

Figure 5:
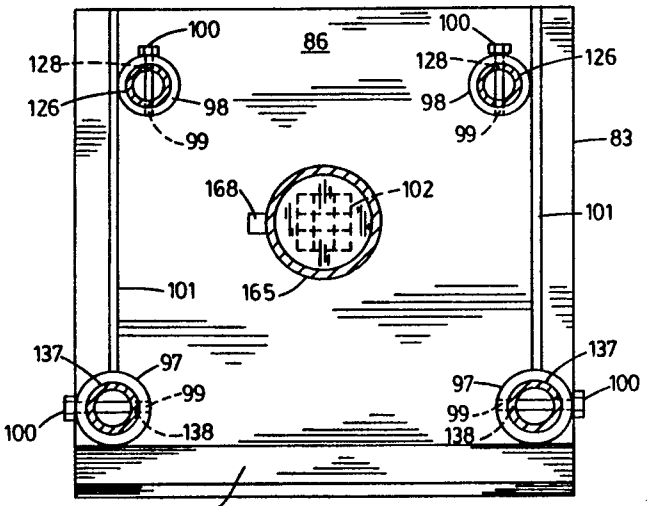
FIG. 5 is a somewhat enlarged transverse, vertical section taken on line 5—5 in FIG. 1.
Figure 9:
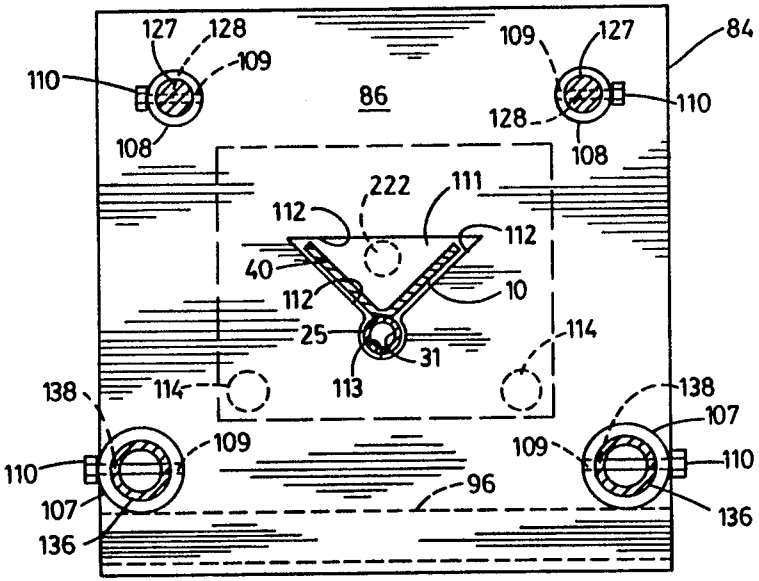
FIG. 9 is a somewhat enlarged transverse, vertical section taken on line 9—9 in FIG. 3.

An angle iron bar 95 is mounted on the inwardly facing surface 86 of end plate 83, as best shown in FIG. 5. Angle iron bar 96 is mounted on the outwardly facing surface 85 of end plate 84, as best shown in FIG. 9. A pair of lower sleeves 97 are mounted, as by welding, on the inwardly facing surface 86 of end plate 83 in spaced relation to each other and in engagement with the angle iron bar extending outwardly from the inwardly facing surface 86 as best shown in FIGS. 1 and 5. A pair of upper sleeves 98 are mounted on the inwardly facing surface 86 of the end plate 83 in spaced relation to each other and extending outwardly from the inwardly facing surface in substantially parallel relation to the lower sleeves 97, as best shown in FIGS. 1 and 5. Each of the lower and upper sleeves 97 and 98 has a lock bolt passage 99 extending therethrough so as to define axes substantially parallel to the inwardly facing surface 86 of the end plate 83. Lock bolts 100 are individually received in the lock bolt passages for purposes hereinafter to be described. A pair of braces 101 are mounted on the inwardly facing surface of the end plate 83 extending in substantially parallel relation from abutted engagement with the corresponding lower sleeves 97 along the inwardly facing surface tangent to the upper sleeves 98, as best shown in FIG. 5. An hydraulic cylinder mount 102 is mounted on the inwardly facing surface of the end plate 83, as best shown in FIGS. 1 and 5.

Figure 1:
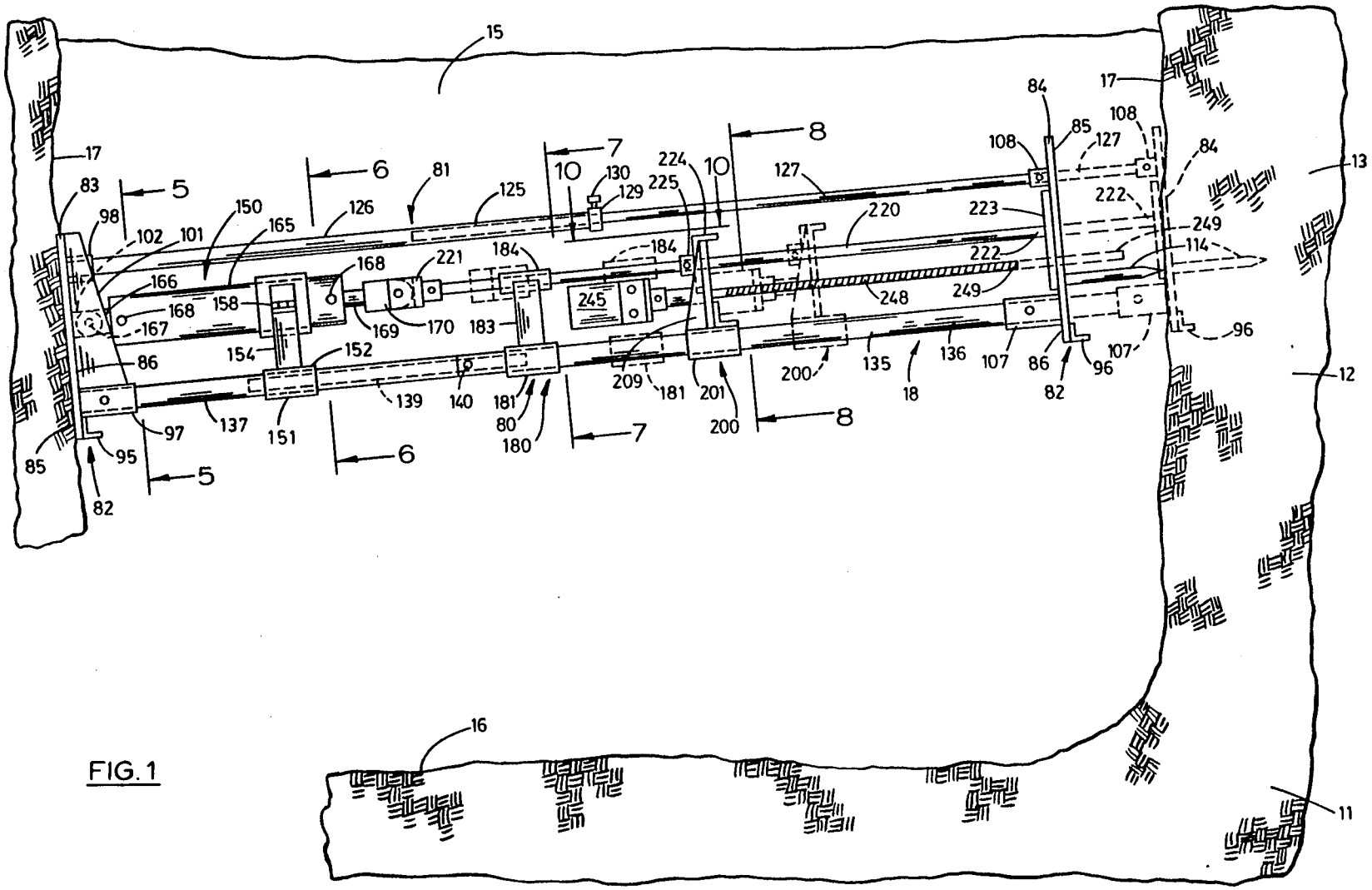
FIG. 1 is a fragmentary, vertical section of a portion of an earth formation showing the apparatus for installation of a work object of the present invention disposed in full lines in a first operable position, and a portion thereof in phantom lines in a second operable position.

A pair of lower sleeves 107 are mounted on the inwardly facing surface 86 of end plate 84 extending outwardly therefrom in spaced, substantially parallel relation, as best shown in FIGS. 1 and 9. A pair of upper sleeves 108 are mounted on the inwardly facing surface 86 of end plate 84 in spaced, substantially parallel relation, also as shown in FIGS. 1 and 9. The lower and upper sleeves each have a lock bolt passage 109 extending transversely thereof in which is individually received a lock bolt 110. The lock bolt passages and the lock bolts can individually be provided with screw threads for screw-threadably securing the lock bolts in the lock bolt passages. An angular passage 111 is formed in the end plate 84 extending therethrough defined by straight peripheral edges 112 of the plate defining a substantially triangular configuration and an arcuate peripheral edge 113 defining substantially a cylindrical passage at the juncture of two of the straight peripheral edges 112, as best shown in FIG. 9. A pair of prongs or spikes 114 are mounted on the outwardly facing surface 85 of end plate 84 in spaced, substantially parallel relation for purposes hereinafter to be described.

The main frame 81 of the apparatus 80 has a pair of upper main frame members 125 extending in spaced, substantially parallel relation between the inwardly facing surfaces 86 of the end plates 83 and 84, respectively, as best shown in FIG. 1. Each of the upper main frame members 125 has a sleeve 126 and a rod 127, the rod slidably received within the sleeve. Lock bolt passages 128 individually extend through the opposite ends of the sleeves 126 and rods 127 in positions adapted for individual alignment with the lock bolt passages 99 of the upper sleeves 98 and with the lock bolt passages 109 of upper sleeves 108. The lock bolts 100 are employed to secure the sleeves 126 in their respective sleeves 98 and the lock bolt 110 are employed to secure the rods 127 in the upper sleeves 108.

A lock ring 129 is mounted on the end of each sleeve 126 on the right, as viewed in FIG. 1. A lock bolt 130 is screw-threadably extended radially into the lock ring for movement to and from binding engagement with the rod 127. Thus, the lock bolt can be employed to release the sleeve 126 and rod 127 for slidable movement relative to each other and, once the desired length for the upper frame members is achieved, tightened downwardly into binding engagement with the rod to set the effective length of each upper frame member.

The main frame 81 has a pair of guide rails or lower main frame members 135 each including a sleeve 136 and a sleeve 137. The sleeves 136 and 137 have the same diameter with lock bolt passages 138 extending transversely through corresponding end portions thereof in positions to align with the lock bolt passages 99 of the lower sleeves 97 of end plate 83 and with the lock bolt passages 109 of the lower sleeves 107 of end plate 84. The sleeves 136 are retained in these positions in their respective lower sleeves 107 by lock bolts 110 extended through the aligned lock bolt passages. The sleeves 137 are individually retained in their respective lower sleeves 97 by lock bolts 100 individually extending through the aligned lock bolt passages. A rod 139 is received within sleeve 136 on the right, as viewed in FIG. 1, and is retained in position by a pin 140. Thus, it will be seen, that the effective length of the lower main frame members can be adjusted by moving the sleeves 136 and 137 to and from each other with the rod 139 sliding within the sleeve 137.

Figure 6:
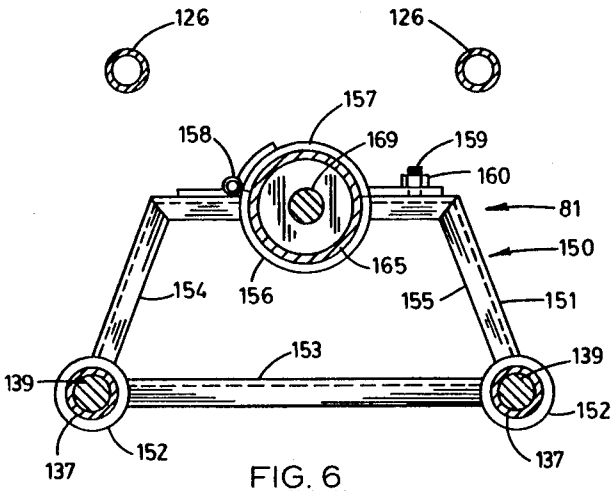
FIG. 6 is a somewhat enlarged transverse, vertical section taken on line 6—6 in FIG. 1.

As shown best in FIGS. 1, 5 and 6, an hydraulic ram or cylinder assembly 150 is mounted in the main frame 81. The hydraulic cylinder assembly includes a support frame 151 having a pair of sleeves 152 which are individually slidably received on the sleeves 137 of the lower main frame members 135. The support frame has a frame member 135 individually mounted on and extending between the sleeves 152. A frame member 154 is mounted on the sleeve 152 on the left as viewed in FIG. 6 and extends upwardly therefrom. A frame member 155 is mounted on the sleeve 152 on the right as viewed in FIG. 6 and extends upwardly therefrom. The remote ends of the frame members 154 and 155 are interconnected by an arcuate cradle 156. A latch 157 is mounted on the frame member 154 by a hinge 158 for movement to and from a position in covering relation to the arcuate cradle. A bolt 159 is mounted on the frame member 155 in upstanding relation for engagement by the latch 157. A nut 160 is adapted to be secured on the bolt so as releasably to lock the latch 157 in the closed position shown in FIG. 6 in covered relation to the arcuate cradle 156.

An hydraulic ram or cylinder 165 is mounted by a flange 166 on the hydraulic cylinder mount 102 of end plate 83 for pivotal movement about an axis parallel to the inwardly facing surface 86 of end plate 83 and normal to braces 101 thereof. The flange 166 is retained in the hydraulic cylinder mount 102 for such movement by a pin 167. The hydraulic cylinder is rested in the arcuate cradle 156 and has a pair of conduit connections 168. The hydraulic cylinder is of the conventional type having a cylinder rod 169 communicating with a piston, not shown, within the hydraulic cylinder and mounting a clevis 170 at the outwardly extending end thereof. The hydraulic cylinder is operated in the conventional manner by any suitable hydraulic system, not shown.

Figure 7:
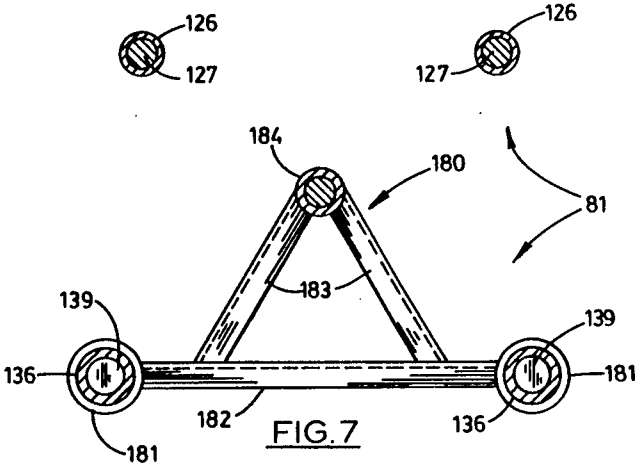
FIG. 7 is a somewhat enlarged transverse, vertical section taken on line 7—7 in FIG. 1.

The main frame 81 has a support frame 180 shown best in FIGS. 1 and 7. The support frame has a pair of lower sleeves 181 which are individually, slidably received on the sleeves 136 of the lower main frame members 135. A frame member 182 is mounted on and interconnects the lower sleeves 181. A pair of frame members 183 are mounted on the frame member 182 and extend upwardly therefrom in converging relation and mount an upper sleeve 184 on the ends thereof.

Figure 10:
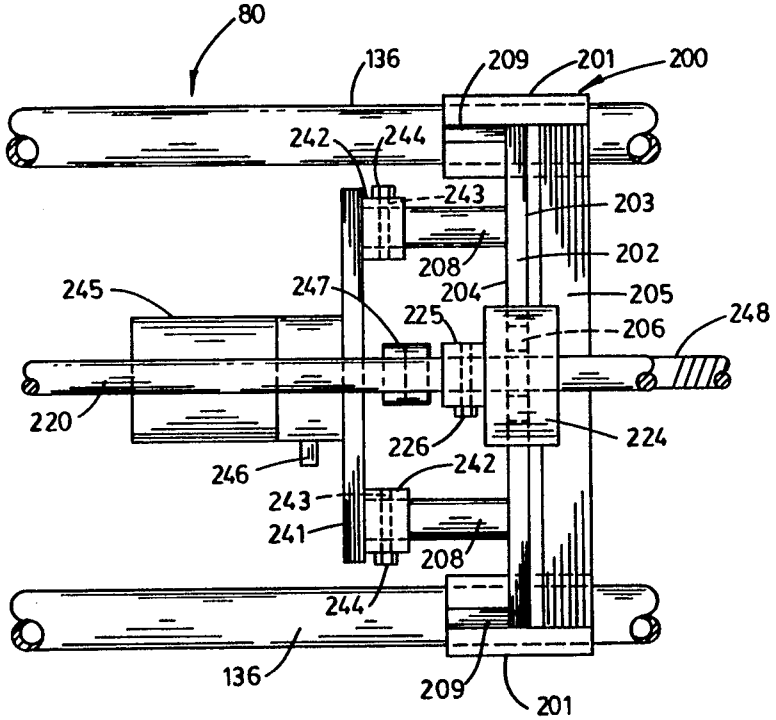
FIG. 10 is a somewhat enlarged, fragmentary horizontal section taken on line 10—10 in FIG. 1.

A carrier or control frame 200 of the main frame 81 is shown best in FIGS. 1, 2, 3, 8 and 10. The control frame has a pair of sleeves 201 individually slidably received on the sleeves 136 of the lower main frame members 135 for slidable movement therealong. The sleeves 201 are interconnected by a plate 202 having a front surface 203 and an opposite back surface 204. An angle iron bar is mounted on the front surface of the plate and is rested on the sleeves 201. A vertical slot 206 is formed in the plate extending from the top edge thereof downwardly to a lower end portion 207 having a rounded configuration. A pair of mounting rods 208 are mounted on the back surface 204 of the plate 202 extending outwardly therefrom in spaced, substantially parallel relation as best shown in FIG. 10. A pair of braces 209 are individually mounted on the sleeves 201 and extend upwardly therefrom and are mounted on the back surface 204 of the plate so as to impart additional strength to the control frame.

Figure 2:
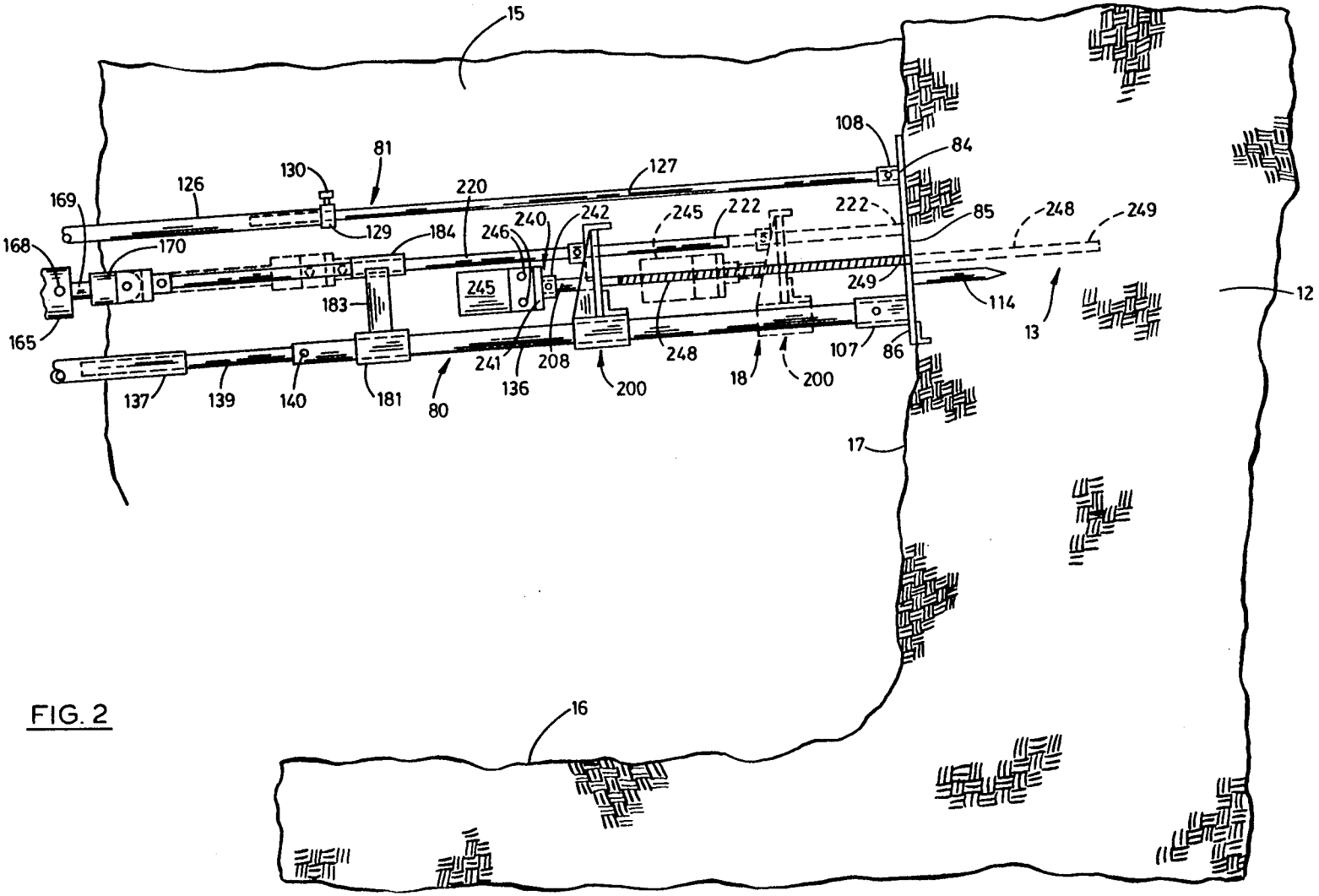
FIG. 2 is a fragmentary, vertical section of a portion of the earth formation shown in FIG. 1 with the apparatus disposed in a third operable position.
Figure 3:
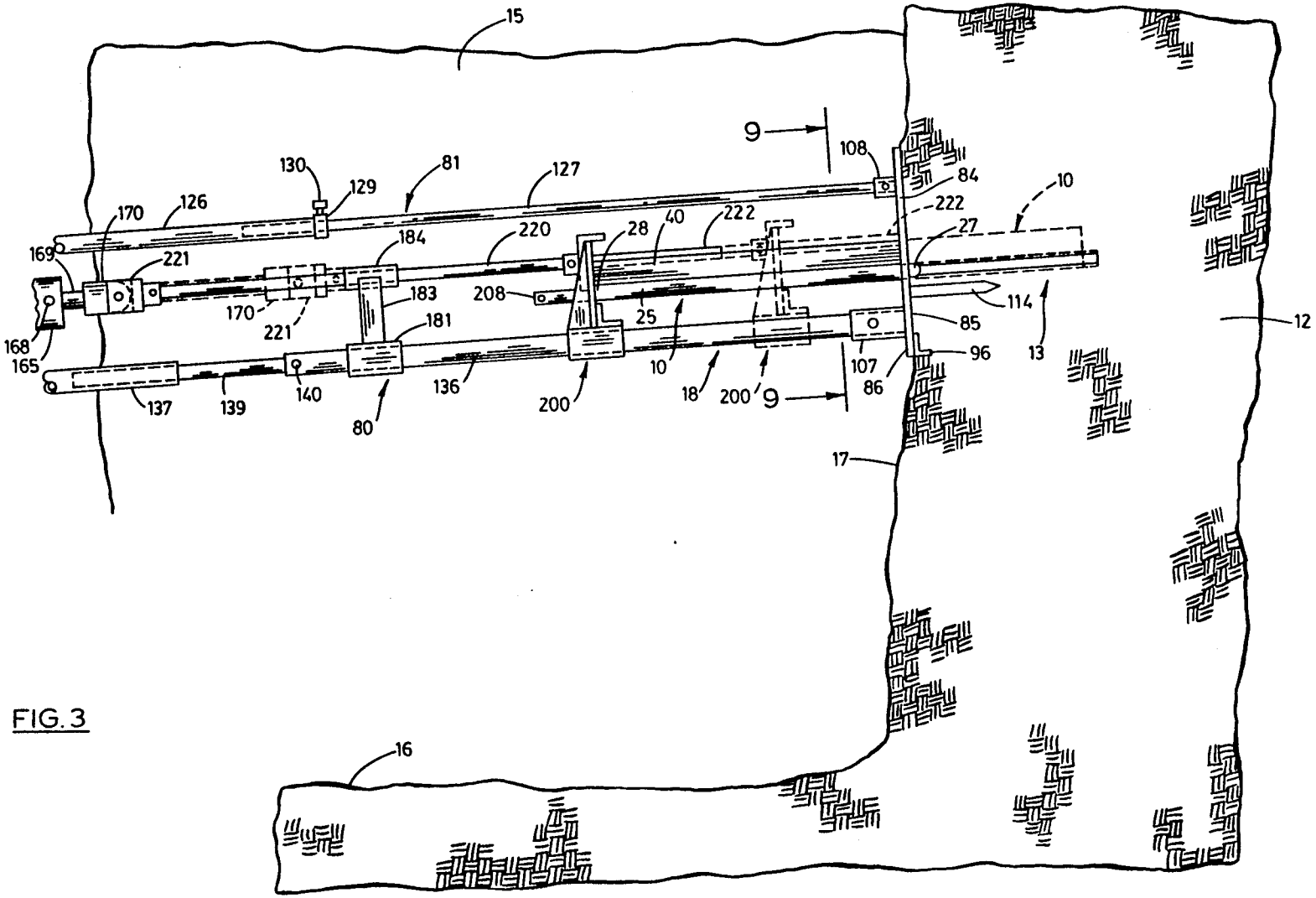
FIG. 3 is a fragmentary, vertical section of the portion of the earth formation shown in FIG. 2 with the apparatus disposed in a fourth operable position.

A drive rod 220, having a clevis 221 at the end thereof on the left as viewed in FIG. 1, is mounted on the clevis 170 of the hydraulic cylinder 165 for pivotal movement about an axis substantially parallel to the pin 167 of the hydraulic cylinder 165. The drive rod is slidably extended through the upper sleeve 184 of the support frame 180 and the vertical slot 206 of the control frame 200. The drive rod has a remote end portion 222. The drive rod is movable to and from the inwardly facing surface 86 of end plate 84, as will hereinafter be described in greater detail. During a portion of this process, a face plate 223 is adapted to be captured between the remote end portion 222 of the drive rod 220 and the inwardly facing surface 86 of end plate 84, as best shown in FIG. 1. An angle bracket 224 is mounted on the back surface 204 of the plate 202 of the control frame 200 and mounts a collar 225 on the left side thereof as shown in FIG. 1, 2 and 3 in axial alignment with the drive rod 220. The drive rod is slidably extended through the collar and is adapted to be secured relative to the control frame by a locking pin 226 extending radially into the collar for binding engagement with the outer surface with the drive rod. Thus, the locking pin can be moved to and from such engagement for purposes alternatively of locking the control frame is a selected position on the drive rod, or releasing the control frame for repositioning on the drive rod.

Figure 8:
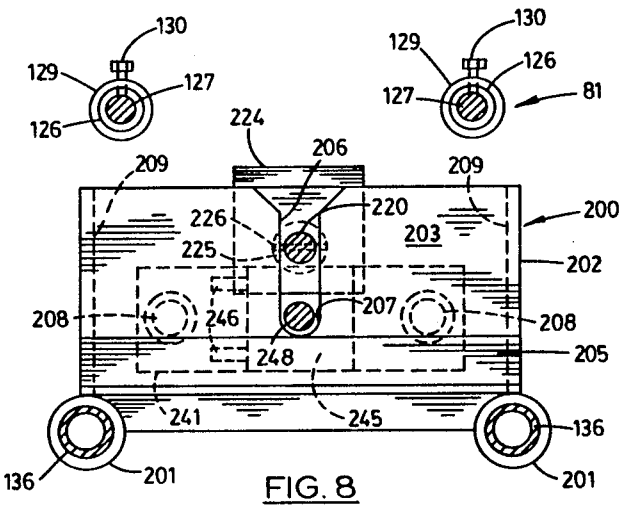
FIG. 8 is a somewhat enlarged transverse, vertical section taken on line 8—8 in FIG. 1.

The apparatus 80 mounts an auger assembly 240 best shown in FIGS. 1, 2, 3 and 10. The auger assembly includes a mounting plate 241 having a pair of sleeves 242 extended therefrom for individual slidable receipt on the mounting rods 208. The sleeves have lock bolt passages 243 adapted individually to receive lock bolts 244 to extend through corresponding lock bolt passages, not shown, in mounting rods 208 for purposes of releasably securing the mounting plate 241 thereon. A conventional hydraulic motor 245 is mounted on the mounting plate 241 and has a pair of conduit connections 246. The conduit connections are adapted to be connected to any suitable hydraulic system, not shown, for purposes of operating the hydraulic motor, as will hereinafter be described in greater detail. The hydraulic motor mounts a chuck 247 extended through the mounting plate 241 in the direction of the control frame 200. The chuck is adapted to receive an auger 248 therein extending through the lower end portion 207 of the vertical slot 206 of the control frame, as best shown in FIG. 8. The auger has a remote end 248.

METHOD AND OPERATION OF THE DESCRIBED EMBODIMENT

The operation of the described embodiment of the subject invention is believed to be readily apparent and is briefly summarized at this point.

In accordance with the practice of the method of the present invention, a determination is first made as to the portion of the formation 12 within which fluids are percolating and from which the fluids are to be collected. This will, of course, be controlled by the objectives of the job assignment. Once this determination has been made, a first location is selected within the portion of the formation at which the fluids are to be collected. This location will normally be along an axis which is substantially horizontal and which is beneath the portion of the formation from which fluids are to be collected. Thereafter, a chamber or trench 15 is excavated in the earth 11 immediately laterally disposed relative to the first location and the formation and preferably to a depth somewhat below that of the first location. A second location is then selected within the trench laterally disposed relative to the first location. The second location is the portion at which the apparatus for installing a work object 80 is to be mounted in possible.

Accordingly, the apparatus 80 is lowered into the trench and adjusted as to length so that the effective length thereof is shorter than the horizontal distance between the wall surfaces 17 of the trench. Adjustment of the length of the apparatus 80 is conveniently achieved by simply loosening the lock bolts 130 of the lock rings 129 of the upper main frame members 125 to permit slidable movement of the rods 127 within the sleeves 126 thereof. The end plates 83 and 84 are simply forced toward each other to accomplish such fore shortening of the main frame 81. The shortest effective length thereof is shown in full lines in FIG. 1.

The apparatus 80 is then positioned in the position shown in FIG. 1 with the outwardly facing surface 85 of end plate 83 in facing engagement with the wall surface 17 of the trench 15 and the spikes 114 of end plate 84 disposed as shown in FIG. 1. At this time, the hydraulic cylinder 165 has its cylinder rod 169 fully contracted, the remote end portion 222 of the drive rod 220 is disposed in abutted engagement with the face plate 223. The face plate is positioned in facing engagement with the inwardly facing surface 86 of end plate 84 in covering relation to the angular passage 111, as shown in phantom lines in FIG. 9. The hydraulic cylinder 165 is then operated, using the hydraulic system, not shown, to move the cylinder rod 169 and thus the drive rod 220 to the right as viewed in FIG. 1. Since the lock bolts 130 have been loosened, this movement forces the rods 127 slidable outwardly relative to the sleeves 126 of the upper main frame members 125 and the sleeves 136 of the lower main frame members 135 from the sleeve 137 drawing the rods 139 outwardly relative to the sleeves 137. Such operation of the hydraulic cylinder causes the spikes 114 to be driven through the wall surface 17 on the right, as viewed in FIG. 1, and into the formation 112 until the outwardly facing surface 85 of end plate 84 is forced into facing engagement with the wall surface 17. Upon reaching this degree of expansion, the operation of the hydraulic cylinder 165 is terminated and the lock bolts 130 are tightened into position to lock the rods 127 within the sleeves 126 so as to set the effective length of the upper main frame members 125.

The apparatus 80 is thus mounted in the second location 18 extending between the wall surfaces 17 of the trench 15 and in lateral alignment with the first location 13. The locking pin 226 of the control frame 200 is now loosened to permit slidable movement of the drive rod relative thereto and the hydraulic cylinder 165 is again operated, using the hydraulic system not shown, to retract the drive rod slightly to release the face plate 223. The face plate is then removed so as to expose the angular passage 111.

The control frame 200 is positioned on the drive rod 220 in the relative position shown in FIG. 2 with the remote end 249 of the auger 248 received just within the angular passage 111 in the portion defined by the arcuate peripheral edge 113. The locking pin 226 is then again tightened down to secure the control frame relative to the drive rod. Using the hydraulic system, not shown, the hydraulic cylinder 165 is slowly expanded to move the drive rod slowly to the right as viewed in FIG. 2. Similarly, the hydraulic system is employed to operate the hydraulic motor 245 to rotate the auger 248 so that the auger is moved in through the angular passage 111 in end plate 84 and through the wall surface 17 of the trench 15 to form a bore in the formation extending along the first path or location. This is preferably done with care so as not to disturb the formation.

When a bore of the desired length is formed extending along the first location, operation of the hydraulic motor 245 is terminated and the hydraulic cylinder 165 is operated again using the hydraulic system, not shown, to retract the auger 248 from the bore and outwardly of the angular passage 111 of the end wall 84. The auger is now removed from the chuck 247 and from the apparatus 80 for the next step in the operation.

The apparatus 10 is installed in the apparatus 80 for purposes of inserting apparatus 10 into the formation 12 along the first location 13. At this time, the apparatus 10 is supported in the main frame 81 of the apparatus 80 in the attitude shown in FIG. 3. In this attitude the distal end portion 27 and the cap 32 thereof are received in the angular passage 111 within the portion thereof defined by the arcuate peripheral edge 113 and the angle iron member 40 is received within the portion of the angular passage defined by the straight peripheral edges 112. Thus, the external surfaces 43 rest against the straight peripheral edges 112, as shown in FIG. 9. The proximal end portion 28 of the conduit 25 is received in the lower portion 207 of the vertical slot 206. Thus, the apparatus 10 is captured between the control frame 200 and the end plate 84 with the front surface 203 of the plate 202 engaging the adjacent edges of the angle iron member 40. As can also be seen in FIG. 3, the conduit 25 is aligned with a bore formed by the auger 248.

Subsequently, the hydraulic cylinder 165 is expanded to move the cylinder rod 169, the drive rod 220 and the control frame 200 to the right as viewed in FIG. 3. Such movement is continued with the conduit following the bore along the first location until the control frame reaches approximately the position shown in phantom lines in FIG. 3. This positions the apparatus 10 in approximately the position relative to the formation best shown in FIG. 4. During movement to this position the leading edges of the angle iron member 40 slide cleanly through the formation with minimal disturbance to the formation so that the apparatus 10 is largely received within the first location with the formation 12 thereabove virtually completed undisturbed.

The apparatus 80 is removed from the installed position shown in FIGS. 1, 2 and 3 substantially by a reversal of the steps heretofore described in its installation. The hydraulic cylinder 165 is operated through the hydraulic system, not shown, to retract the drive rod 220 to the position shown in FIG. 1. The lock bolt 130 is released and the end plate 84 pulled away from the wall surface 17 of the trench 15 a sufficient distance to pull the spikes 114 free from the wall surface 17. The apparatus 80 is then lifted out of the trench and its use is not further required for operation of the apparatus 10. Subsequently, the container 51 is installed on the externally screw threaded end portion 33 of the conduit 25 by screw-threadably securing the elbow fitting 54 thereon. The externally screw threaded neck 53 of the container is then threaded into the downwardly facing end of the fitting and tightened into position so as to establish a path of fluid flow into the container through the elbow fitting from the conduit 25.

The apparatus 10 is now fully installed and operable. Depending upon the requirements of the project, any number of other apparatuses 10 can similarly be so installed. Similarly, the trench, if required by the requirements of the project, can be refilled with the apparatus 10 left in position for subsequent recovery upon completion of the test. In any case, over time the fluid within the formation 12 above the first location percolates downwardly along the paths indicated by arrows 14 and is directed toward the plurality of holes 44 and the angle iron member 40 and conduit 25 by contact with the internal surfaces 41 of the angle iron member, as can best be visualized in FIG. 11. The fluid passes into the passage 31 of the conduit through the openings. Since the apparatus 10, as installed slopes slightly downwardly from true horizontal in a direction away from the formation and toward the container 51, the fluid flows along the passage 31, through the elbow fitting 54 and into the interior 52 of the container 51. The ambient air within the interior of the container is expelled by the accumulation of fluid within the interior of the container through the air valve assembly 60 thereof by the creation of air pressure against the ball 65. Thus, the interior of the container can be fully filled with fluid should the time interval of the test result in such an accumulation.

At the end of the test period, if the trench 15 has been refilled, the fill material is, of course, removed in order to reach the apparatus 10. The container 51 is then screw-threadably removed from the elbow fitting 54, sealed and delivered to an appropriate testing lab for evaluation of its contents. The apparatus 10 is simply removed by manually pulling the conduit 25 and angle iron member from the formation 12 along the first location 13.

Therefore, the method and apparatus for collecting percolating fluids of the present invention is operable dependably and precisely to sample percolating fluids in an undisturbed formation without requiring a vast number of such installations, without requiring exorbitantly expensive procedures for achieving such installation and for maintaining the installations once established and are operable to collect percolating fluids of a quantity and content directly corresponding to that of the percolating fluids within the undisturbed formation for precise analysis of the content thereof.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A method for collecting for analysis percolating fluids in a formation in the earth within a substantially unsaturated zone, the method comprising the steps of:

A. selecting a first location within a portion of said formation within which fluids desired to be collected for analysis are percolating;

B. accessing a second location in said formation laterally disposed relative to the first location;

C. moving a receiver, defining a passage internally thereof and having at least one opening on the upper surface thereof communicating with said passage, into the first location from said second location so as to extend therebetween with said opening disposed in receiving relation to said fluids desired to be collected for analysis; and D. collecting for analysis fluid from said receiver which has percolated within said portion of the formation to the first location and passed through said openings into the passage of the receiver.

2. The method of claim 1 wherein said receiver is a conduit having a plurality of openings along an upper surface thereof communicating with said passage for the receipt into said passage of the fluids to be collected for analysis from the portion of said formation.

3. The method of claim 1 including the step of

E. analyzing the fluid collected for analysis in said collecting step to determine the composition thereof.

4. A method for collecting for analysis percolating fluids in a formation of the earth within a substantially unsaturated zone thereof substantially beneath the biologically active root zone and above the ground water within a substantially saturated zone of soil thereof, the method comprising the steps of:

A. determining a portion of said formation in a substantially unsaturated zone thereof within which fluids are percolating;

B. selecting a first location within said portion of the formation from which fluids are to be collected;

C. excavating a trench in said formation laterally disposed relative to the first location and to a depth at least as deep in the formation as the first location;

D. selecting a second location within the trench laterally disposed relative to the first location;

E. driving a conduit, defining a passage internally thereof an having a plurality of openings along the upper surface thereof communicating with said passage, into the first location from said second location so as to extend therebetween;

F. mounting a receptacle on said conduit in the second location in receiving relation to said passage; and G. collecting fluid in said receptacle which has percolated in said portion of the formation to the first location, passed through the plurality of openings of the conduit and into the passage thereof.

5. The method of claim 4 including the step prior to said driving step of forming a bore extending from said second location substantially to said first location.

6. The method of claim 5 wherein said driving step further includes driving said conduit at an angle so as to slope downwardly from the first location to the second location.

* * * * *

UNITED STATES PATENT AND TRADEMARK OFFICE

CERTIFICATE OF CORRECTION

PATENT NO. : 5,228,517

DATED : July 20, 1993

INVENTOR(S) : James R. Brownell

It is certified that error appears in the above-identified patent and that said Letters Patent is hereby corrected as shown below:

Column 8, line 57, delete "portion" and substitute ---position---.

Column 8, line 58, delete "possible" and substitute ---position---.

Column 12, line 33, delete "an" and substitute ---and---.

Signed and Sealed this

Twenty-second Day of February, 1994

Bruce Lehman

*Attest:*

BRUCE LEHMAN

*Attesting Officer*

*Commissioner of Patents and Trademarks*